US010077603B2

(12) United States Patent
Tejeda et al.

(10) Patent No.: US 10,077,603 B2
(45) Date of Patent: Sep. 18, 2018

(54) THREADED CONNECTION

(71) Applicants: Maximo Tejeda, Houston, TX (US); Maximo Tejeda, Jr., Houston, TX (US); G. Leon Starnes, Houston, TX (US); Terry Dobson, Jr., Houston, TX (US)

(72) Inventors: Maximo Tejeda, Houston, TX (US); Maximo Tejeda, Jr., Houston, TX (US); G. Leon Starnes, Houston, TX (US); Terry Dobson, Jr., Houston, TX (US)

(73) Assignee: Tejas Tubular Products, Inc., Houston, TX (US)

( * ) Notice: Subject to any disclaimer, the term of this patent is extended or adjusted under 35 U.S.C. 154(b) by 616 days.

(21) Appl. No.: 14/529,806

(22) Filed: Oct. 31, 2014

(65) Prior Publication Data

US 2016/0123508 A1 May 5, 2016

(51) Int. Cl.
*E21B 1/00* (2006.01)
*E21B 17/042* (2006.01)

(52) U.S. Cl.
CPC ..... *E21B 1/00* (2013.01); *E21B 17/042* (2013.01)

(58) Field of Classification Search
None
See application file for complete search history.

(56) References Cited

U.S. PATENT DOCUMENTS 4,582,348 A * 4/1986 Dearden ..... E21B 17/042 285/148.19
4,619,472 A * 10/1986 Kozono ..... F16L 15/004 285/333
5,212,885 A * 5/1993 Buonodono ..... B23P 19/066 29/407.02
6,237,967 B1 * 5/2001 Yamamoto ..... E21B 17/042 285/333
6,609,735 B1 * 8/2003 DeLange ..... E21B 17/042 285/333

* cited by examiner

*Primary Examiner* — David Bochna
*Assistant Examiner* — James Albert Linford
(74) *Attorney, Agent, or Firm* — Bushman Werner, P.C.

(57) ABSTRACT

A threaded connection for tubing having a pin connection with external, tapered buttress type threads, preferably with a one inch per foot thread taper, the pin threaded portion having seven threads per inch. The connection also includes a box connection having complementary internal threads threadedly engaging the pin, the box connection having a comparable pitch and thread taper.

13 Claims, 5 Drawing Sheets

THREADED CONNECTION

FIELD OF THE INVENTION

The present invention relates to threaded oil field tubulars and, more particularly, to threaded connections used for tubing.

BACKGROUND OF THE INVENTION

Oilfield tubular connections employing standard API threads e.g., 8-round, have been used for many years on tubing and casing. There are certain drawbacks to standard API threads including relatively slow make-up times and a tendency to be weak in tension.

As is well known, in recent years the development of shale formations in the United States for producing both oil and gas has exploded. Indeed, the development of these shale formations has made the United States one of the largest producers of oil and gas in the world and for all intents and purposes has made the United States energy independent. The construction of oil and gas wells in shale formations is difficult. To begin with, a typical well for recovering oil and/or gas from shale formations requires the drilling of a vertical section and a kick off into a lateral or horizontal section. As is known to those skilled in the art, in moving from the vertical section of a well to the lateral section, the threads of a typical oil field tubular go from tension loading to compression loading. These changing forces on the threaded connection lead to instability in the connections resulting in leakage among other problems. In particular, the changing tension to compression forces coupled with make-up torque loads, internal pressure loads, bending loads and torsion loads can render standard API connections unstable, leading to leaks.

SUMMARY OF THE INVENTION

In one aspect, there is provided a buttress type threaded connection for tubing which makes-up faster than standard API connections.

In another aspect, there is provided a buttress type threaded connection, particularly for tubing, which exhibits considerably less galling than a standard API threaded connection i.e., an 8-round connection.

In a further aspect there is provided a buttress type threaded connection for tubing which exhibits greater stability than a standard API connection rendering the API buttress type connection highly suitable for use in deviated boreholes e.g., laterals.

For further features and advantages references is made to the following detailed description, wherein reference is made to the figures in the accompanying drawings.

DETAILED DESCRIPTION OF PREFERRED EMBODIMENTS

While the thread form described and claimed herein can be used on tubing and casing, it is particularly useful on tubing having an OD of 4.5 inches and below. The terms "box", "box connection" and similar term refers to a tubular member having an internally threaded section. The terms "pin," "pin connection," or similar term refers to a tubular member having an externally threaded section. It is a feature of the thread form and the threaded connections using the thread form that the threads are tapered threads having a taper of 1 inch per foot, the thread pitch being 7. The threads of the thread form of the threaded connections have a thread height of from about 0.042 to about 0.046 inches, particularly about 0.044 inches.

Figure 1:
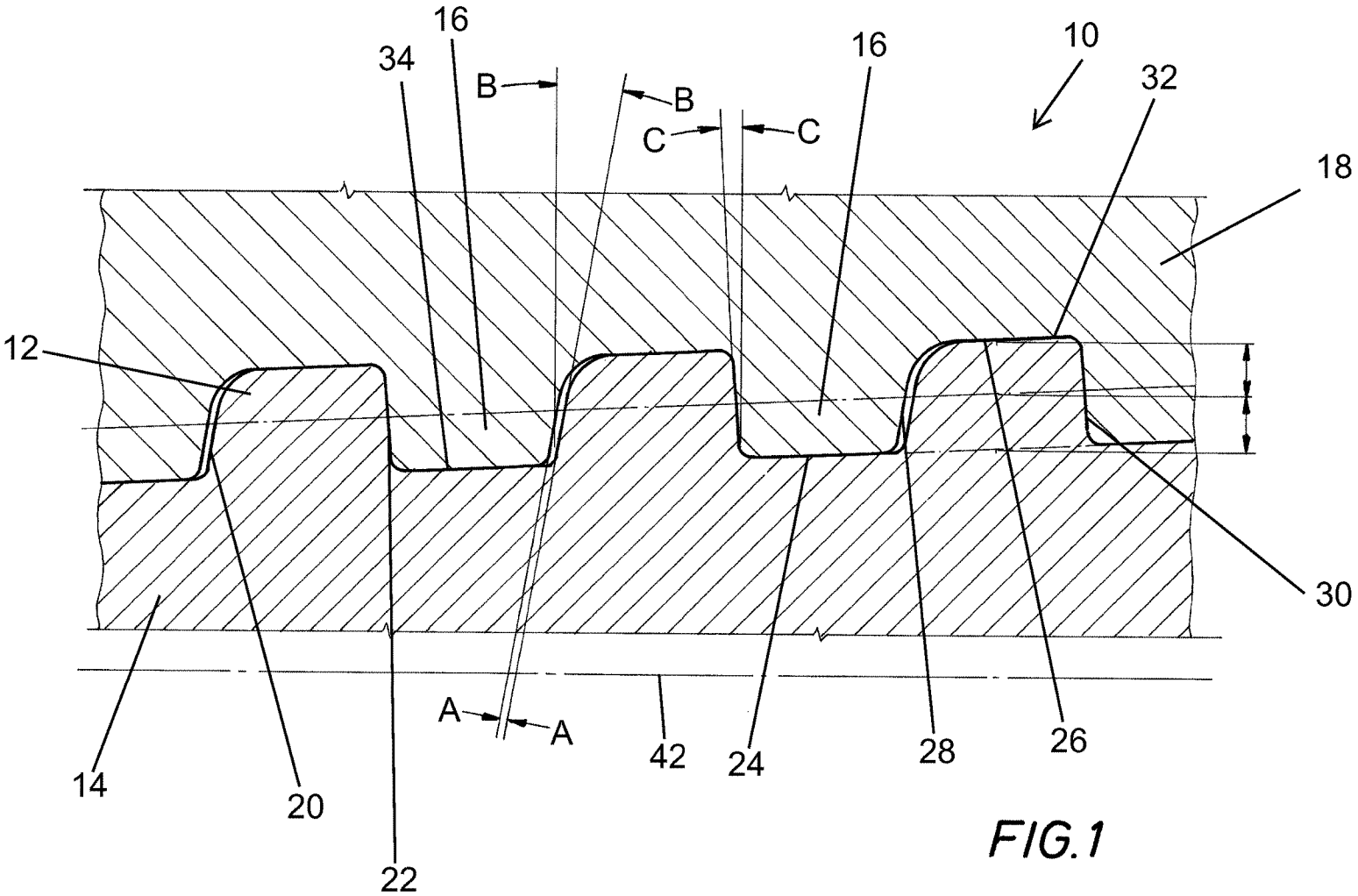
FIG. 1 is a partial, cross-sectional view of the thread form of a threaded connection.

Referring first to FIG. 1, the thread form, shown generally as 10, is shown with respect to the threads 12 of a pin 14 threadedly engaged with the threads 16 of a box 18. Pin threads 12 have a stab flank 20, a load flank 22, a root 24 and a crest 26. Box threads 16 have a stab flank 28, a load flank 30, a root 32 and a crest 34. As seen, in the fully made-up position depicted in FIG. 1 the load flanks 22, 30 of the pin, box, respectively, are engaged, the respective crests and roots of the pin threads 12 and the box threads 16, are engaged and there is a clearance, depicted by the arrows A-A, between the stab flanks of the pin threads 12 and the box threads 16.

As can also be seen from FIG. 1, the stab flanks 20 of the pin 14 and stab flanks 28 of the box 18 are at a positive angle designated as B-B on FIG. 1 relative to a line passing transversely through the pin/box connection and perpendicular to the product axis 42. In this regard product axis 42 passes longitudinally through the center line of the pin/box connection and is generally concentric with the OD of the box 18 and the ID of the pin 14. Generally speaking, the angle B-B is from about 8° to about 12° , particularly about 10°. The load flanks 22 of the pin 14 and the load flank 30 of the box 18 when in the fully made up position as shown in FIG. 1 are at a positive angle C-C of from about 2° to about 4° especially about 3° again with respect to the product axis 42.

When the pin/box connection of FIG. 1 is made up the clearance A-A is from about 0.002 to about 0.004 inches, particularly about 0.003 inches.

Figure 2:
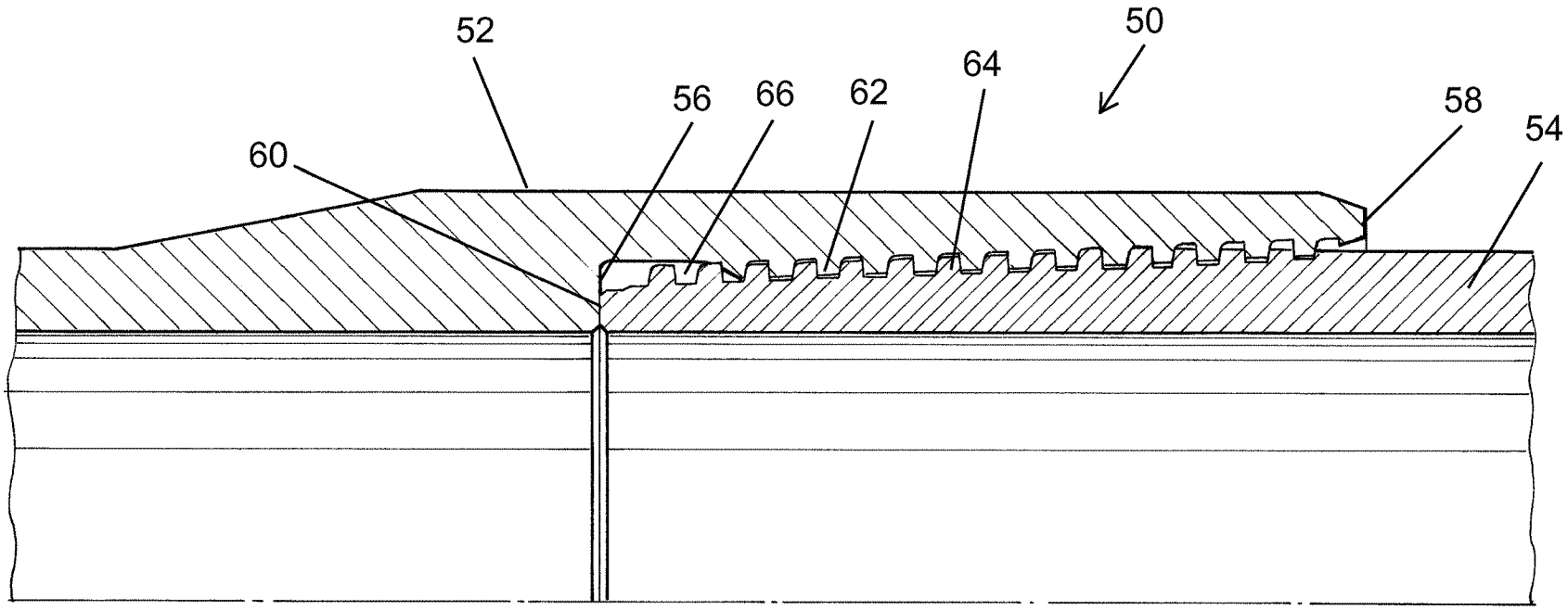
FIG. 2 is an elevational view, partly in section, of one embodiment of a threaded connection utilizing the thread form of FIG. 1.

Referring now to FIG. 2, the thread form depicted in FIG. 1 is shown in connection with an integral joint, shown generally as 50 and comprised of a box 52 and a pin 54 threadedly received therein. Box 52 has an annular, axially facing internal torque shoulder 56 and a box end 58.

Pin 54 has a pin nose 60, pin nose 60 engaging shoulder 56 when pin 54 and box 52 are made up as shown in FIG. 2. Again it will be understood that the threads 62 of box 52 and the threads 64 of pin 54 are generally as described above with respect to the pin and box shown in FIG. 1. As can also be seen in FIG. 2, box 52 has an annular, radially inwardly extending recess or thread relief 66, which can also act as a reservoir for receiving excess pipe dope. As can also be seen, the threaded portions of pin 54 and box 52 are run out threads.

Figure 3:
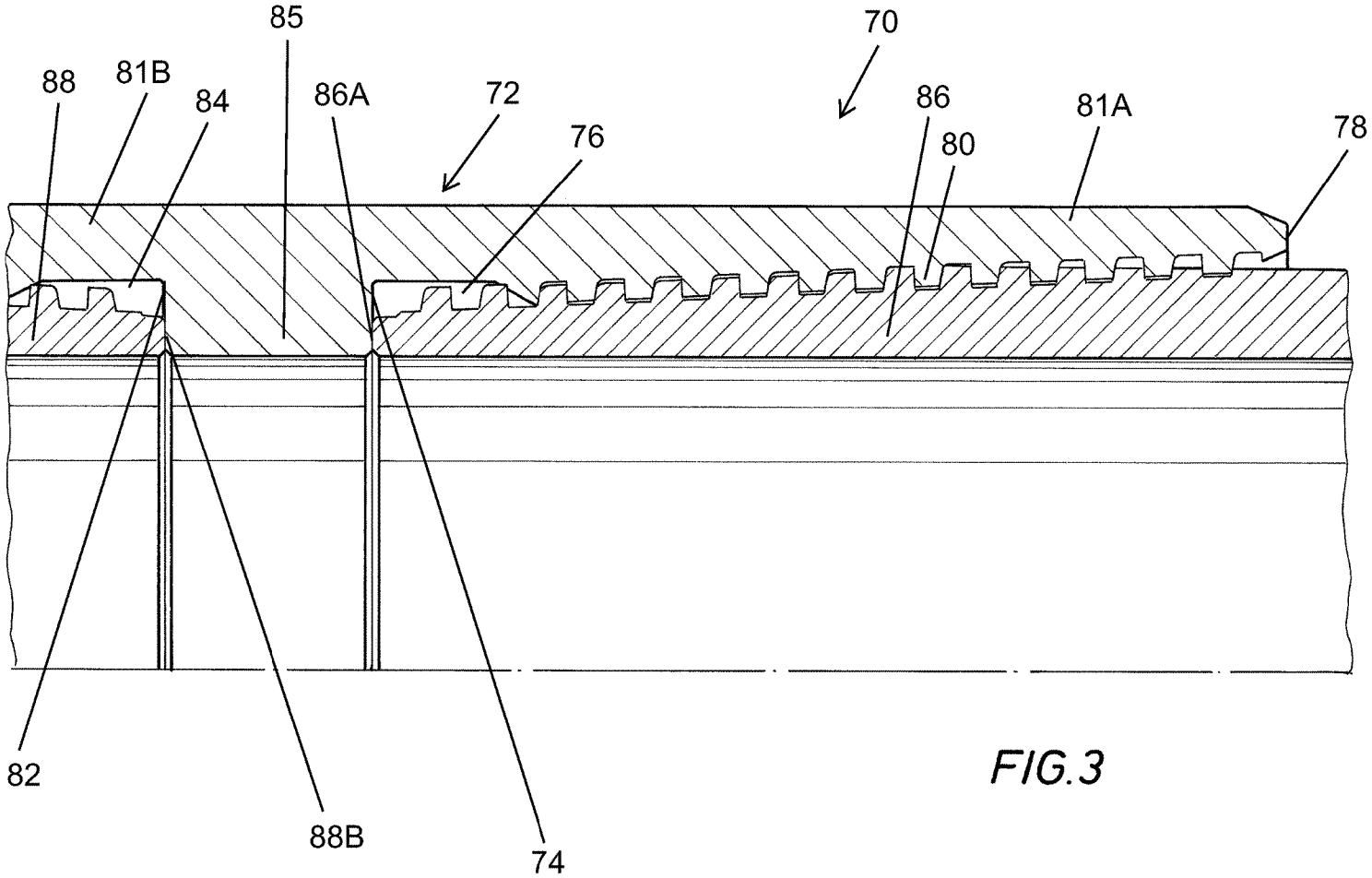
FIG. 3 is a view similar to FIG. 2 showing another embodiment of a threaded connection utilizing the thread form of FIG. 1.

Referring now to FIG. 3 there is shown another embodiment of the present invention wherein the threaded connection comprises a coupled connection, shown generally as 70.

Coupled connection 70 comprises a coupling body shown generally as 72, only one end of which is shown, it being understood that the other end is the same. Coupling body 72 has an internal, annular radially inwardly projecting rib 85, a first internal, annular, axially facing shoulder 74 formed on rib 85, a first radially inwardly projecting, annular thread relief 76 adjacent shoulder 74, a first end 78 and a first internally threaded portion having box threads 80 as described above with respect to the box threads 16 depicted in FIG. 1. Accordingly coupling body 72 forms a first box connection 81A bounded generally by shoulder 74 and first end face 78.

Coupling body 72 also forms a second box connection 81B having a second annular, axially facing shoulder 82 formed on rib 85 and a radially inwardly extending annular thread relief 84, a second box connection 81B being generally bounded by shoulder 82 and a second end face (not shown).

Coupled connection 70 also comprises a first pin 86 and a second pin 88, pins 86 and 88 having first and second pin noses 86A and 88B, respectively. When made up as shown in FIG. 3, first pin 86 and second pin 88 will be received in first box 81A and second box 81B, respectively pin noses 86A and 88B being made-up to a desired torque against shoulders 74 and 82, respectively. Connection 70, as seen, has a generally flush ID as in the case of connection 50 shown in FIG. 2.

Figure 4:
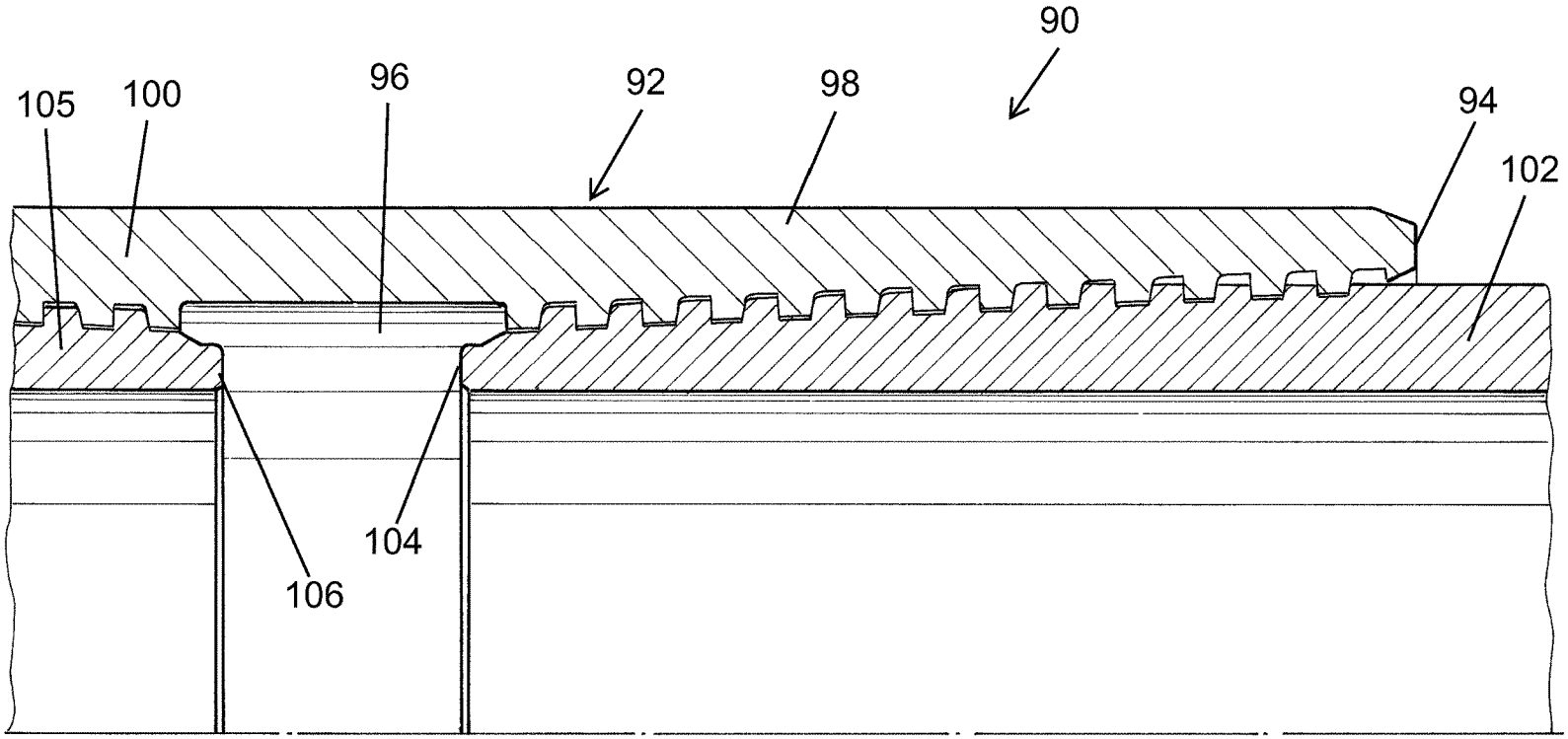
FIG. 4 is a view similar to FIG. 3 showing another embodiment of a threaded connection utilizing the thread form of FIG. 1.

Referring now to FIG. 4, there is shown another embodiment of the present invention which is an unshouldered, coupled connection, shown generally as 90. Connection 90 comprises a coupling body 92 only one end of which will be described in detail, it being understood that the other end is the same. Coupling body 92 has a first end 94 a second end (not shown) an internal, radially outwardly extending annular relief 96, coupling body 92 forming a first box connection 98 extending from first end 94 to relief 96 and a second box 100 extending from the second end (not shown) of coupling body 92 to relief 96. As shown, first and second boxes 98 and 100 are internally threaded, the threads corresponding to those described above with respect to the box threads shown in FIG. 1.

Threaded connection 90 also comprises a first pin 102 having a first pin nose 104, the threads of first pin 102 corresponding to the pin threads described above with respect to the thread form shown on FIG. 1. There is also a second pin 105, the threads of the second pin 105 corresponding to the pin threads shown in FIG. 1. Second pin 105 has a second pin nose 106, pin noses 104 and 106 being spaced from one another when the connection is fully made up as is shown in FIG. 4. The coupled connection 90 shown in FIG. 4 is of a type wherein the pins 102 and 105 are made-up to position i.e. the pins 102 and 105 are threaded into the boxes 98 and 100 to a desired torque value. At this point the connection is fully made up. Thus, unlike the embodiment shown in FIG. 3, where there is an internal annular rib 85 forming torque shoulders 74 and 82, as noted above coupling body 92 has a central relief 96. Accordingly, and again unlike the coupled connection shown in FIG. 3, the coupled connection 90 does not have a flush ID.

Figure 5:
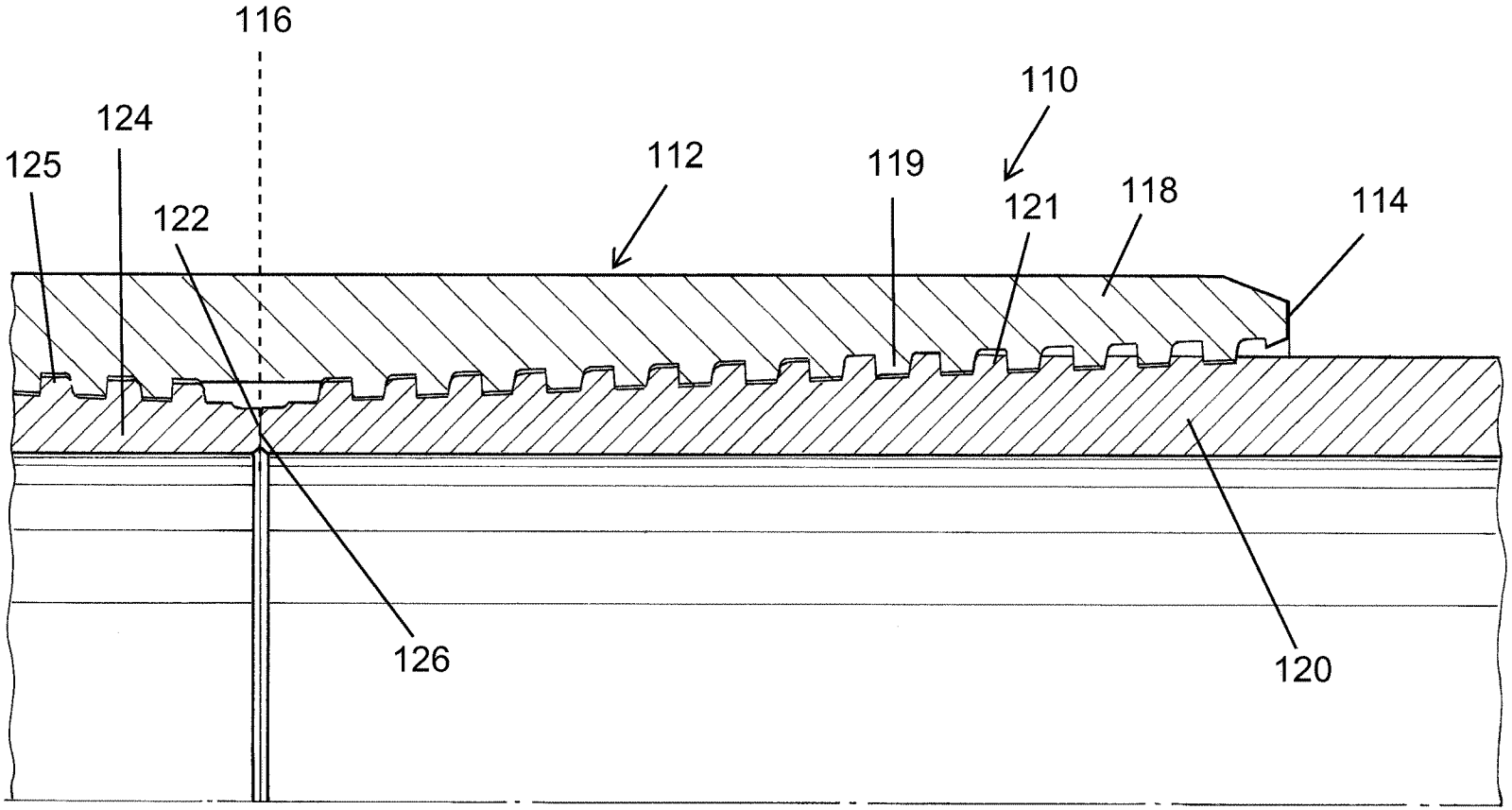
FIG. 5 is a view similar to FIG. 3 showing another embodiment of a threaded connection utilizing the thread form of FIG. 1.

Referring now to FIG. 5 there is shown yet another embodiment of the present invention which comprises a coupled connection, shown generally as 110. Coupled connection 110 comprises a coupling body 112 having a centerline 116 perpendicular to a product axis (not shown) like product axis 42 in FIG. 1 having a first end 114 and a second end (not shown). Coupling body 112 forms a first box 118 which extends generally from first end 114 generally to the center line 116 of coupling body 112 passing transversely through coupling body 112. A female, threaded section extends between first end face 114 and center line 116, the threads 119 of the box 118 being as described above with respect to the box threads described in FIG. 1.

Coupled connection 110 also includes a first pin 120 having an externally threaded section, the threads 121 of pin connection 120 being as described above with respect to the pin threads described in FIG. 1. First pin 120 has a first pin nose 122. Coupling connection 110 also includes a second pin 124, the threads 125 of which correspond to the pin threads described in FIG. 1. Second pin 124 has a second pin nose 126. As seen in FIG. 5, when the coupled connection 110 is fully made up, pin noses 122 and 126 are in abutting relationship. Accordingly, the coupled connection 110 has an internally flush ID.

The benefits of the thread form and the threaded connections of the present invention provide unexpected results in terms of a reduced degree of galling. Also, it is known that Standard API Buttress threads on casing connection typically undergo galling after two to three make-ups but in any event after about five make-ups. In tests conducted on tubing connections made in accordance with the buttress type thread form of the present invention, and having a pipe diameter of 4.5 inches or less, it has been found that the tubing connections can undergo up to ten or more make-and-breaks without any significant galling. This is a significant advantage since it dramatically increases the usable life of the tubing before it must be reworked or replaced altogether. Furthermore, when in use, this reduced degree of galling ensures internal pressure integrity.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A threaded connection comprising:

a first pin connection having an outside diameter (hereinafter referred to as OD), a long axis coaxial with said OD, and a first pin nose, said first pin connection comprising a first pin threaded portion having external, tapered buttress-type first pin threads having a stab flank, a load flank, a root, and a crest, said first pin threaded portion having a one inch per foot thread taper with respect to said long axis of said first pin connection, said first pin threaded portion having a constant pitch of 7 threads per inch;

a first box connection for threadedly receiving said first pin connection, said first box connection having an OD and a first long axis coaxial with said OD, said first box connection comprising a first box threaded portion having internal, threaded, tapered buttress-type first box threads having stab flanks, load flanks, roots, and crests, said first box threaded portion having a one inch per foot thread taper with respect to said first long axis of said first box connection, said first box threaded portion having a constant pitch of 7 threads per inch, said first pin threads and said first box threads having a thread height of from 0.042 to 0.046 inches, said stab flanks of said pin threads and said box threads being at a positive angle of from 8° to 12° relative to a line passing perpendicular to the connection axis, said load flanks of said pin threads and said box threads being at a positive angle of from 2° to 4° relative to a line passing perpendicular to the connection axis, wherein when a first pin connection is threadedly received in a first box connection and made up, there is a clearance of from 0.002 to 0.004 inches between the stab flanks of the pin threads and the stab flanks of the box threads, the load flanks of the pin threads and the box threads are engaged and the crests and roots of the box threads and pin threads are engaged.

2. The threaded connection of claim 1 wherein said first pin threads are run out threads.

3. The threaded connection of claim 1 wherein each of said first pin threads have a root, a crest, a stab flank and a load flank, said stab flanks of said first pin threads being at a positive angle of from 8° to 12° with respect to said long axis of said first pin connection, each of said load flanks of said first pin threads being at a positive angle of from 2° to 4° with respect to said long axis of said first pin connection, said first box threads having a root, a crest, a stab flank and a load flank, said stab flanks of said first box threads being at a positive angle of from 8° to 12° with respect to said long axis of said first box connection, said load flanks of said first box threads being at a positive angle from 2° to 4° with respect to said long axis of said first box connection, said first box connection having an annular, internal, axially facing first shoulder.

4. The threaded connection of claim 3 wherein when said first pin connection and said first box connection are made-up said first pin nose is in engagement with said first shoulder, said long axis of said first pin connection and said first box connection are coincident, said roots and crests of said first pin threads and said first box threads are in engagement, and the clearance between said stab flanks of said first pin threads and said first box threads is from 0.002 to 0.004 inches.

5. The threaded connection of claim 1 comprising a coupling body, said coupling body having a first end face formed on one end of said coupling body and a second end face formed on the other end of said coupling body, an axial bore extending from said first end face to said second end face, said coupling body having a generally centrally disposed, radially inwardly extending annular rib, an annular, axially facing first shoulder and an annular, axially facing second shoulder being formed on said rib, said first box connection being formed in said coupling body and extending generally from said first shoulder to said first end face, a second box connection being formed in said coupling body and extending generally from said second shoulder to said second end face, said second box connection having an OD and a second long axis coaxial with said OD, said first and second long axes being coincident, said second box connection comprising a second box threaded portion having internal, tapered buttress type second box threads, said second box threaded portion having a one inch per foot thread taper with respect to said long axis of said second box connection, said second box threaded portion having a pitch of 7 threads per inch, said second box threads having a thread height of from 0.042 to 0.046 inches.

6. The threaded connection of claim 5 comprising a second pin connection having an OD, a long axis coaxial with said OD, and a second pin nose, said second pin connection comprising a second pin threaded portion having external, tapered buttress type second pin threads, said second pin threaded portion having a one inch per foot thread taper with respect to said long axis of said second pin connection, said second pin threaded portion having a thread pitch of 7 threads per inch, said second pin threads having a thread height of from 0.042 to 0.046 inches.

7. The threaded connection of claim 6 wherein said first and second pin threads are run out threads.

8. The threaded connection of claim 6 wherein each of said first and second pin threads have a root, a crest, a stab flank and a load flank, each of said stab flanks of said first and second pin threads being at a positive angle of from 8° to 12° with respect to said long axis of said first and second pin connections, respectively, said load flanks of said first and second pin threads being at a positive angle of from 2° to 4° with respect to said long axis of said first and second pin connections, respectively, said first and second box threads have a root, a crest, a stab flank and a load flank, said stab flanks of said first and second box threads being at a positive angle of from 2° to 4° with respect to said long axis of said first and second box connections, respectively, said load flanks of said first and second box threads being at a positive angle from 2° to 4° with respect to said long axis of said first and second box connections, respectively.

9. The threaded connection of claim 8 wherein when said first and second pin connections are made-up in said first and second box connections, respectively, said first and second pin noses are in engagement with said first and second shoulders, respectively, the long axis of said pin connections and said box connections are coincident, the roots and crests of said first and second pin threads and said first and second box threads are in engagement, the load flanks of said first and second pin threads and said first and second box threads are in engagement and the clearance between the stab flanks of said first and second pin threads and said first and second box threads, respectively, is from 0.002 to 0.004 inches.

10. The threaded connection of claim 1 comprising a coupling body, said coupling body having a first end and a second end said first box connection being formed in said coupling body and extending from said first end face axially inward, a second box connection being formed in said coupling body and extending from said second end face axially inward, said second box connection having an OD and a long axis coaxial with said OD, said second box connection comprising a second box threaded portion having internal, tapered buttress type second box thread, said second box threaded portion having a one inch per foot thread taper with respect to said long axis of said second box connection, said second box threaded portion having a constant pitch of 7 threads per inch, said thread height of said second box threads being from 0.042 to 0.046 inches, said second box threads having stab flanks, load flanks, roots, and crests, said stab flanks of said second box threads being at a positive angle of from 8° to 12° relative to a line passing perpendicular to the connection axis, said load flanks of said second box threads being a positive angle of from 2° to 4° relative to a line passing perpendicular to the connection axis, wherein when a second pin connection is threadedly received in said second box connection and made up, there is a clearance of from 0.002 to 0.004 inches between the stab flanks of the pin threads and the stab flanks of the box threads, the load flanks of the pin threads and the box threads are engaged and the crests and roots of the box threads and pin threads are engaged.

11. The threaded connection of claim 10 wherein there is a second pin connection having an OD, a long axis coaxial with said OD, and a second pin nose, said second pin connection comprising a second pin threaded portion having external, tapered buttress type second pin threads, said second pin threaded portion having a one inch per foot threaded taper with respect to said long axis of said second pin connection, said second pin threaded portion having a constant pitch of 7 threads per inch, said second pin threads having a thread height of from 0.042 to 0.046 inches, said second pin threads having stab flanks, load flanks, roots, and crests, said stab flanks of said second pin threads being at a positive angle of from 8° to 12° with respect to said long axis of said second pin connection, said load flanks of said second pin threads being at a positive angle of from 2° to 4° with respect to said long axis of said second pin connections, wherein when said second pin connection is threadedly received in said second box connection and made up, there is a clearance of from 0.002 to 0.004 inches between the stab flank of the pin threads and the stab flanks of the box threads, the load flanks of the pin threads and the box threads are engaged and the crests and roots of the box threads and pin threads are engaged.

12. The threaded connection of claim 11 wherein said first and second pin threads are run out threads.

13. The apparatus of claim 11, wherein when said first and second pin connections are threadedly received in said first and second box connections, respectively, said first pin connection is made-up to a first position and said second pin connection is made-up to a second position, said first and second positions corresponding to first and second torque values, respectively, and the clearance between the stab flanks of said first and second pin threads and said first and second box threads, respectively, is from 0.002 to 0.004 inches.

* * * * *